United States Patent [19]

Leupold

[11] Patent Number: 4,701,737

[45] Date of Patent: Oct. 20, 1987

[54] LEAKAGE-FREE, LINEARLY VARYING AXIAL PERMANENT MAGNET FIELD SOURCE

[75] Inventor: Herbert A. Leupold, Eatontown, N.J.

[73] Assignee: The United States of America as represented by the Secretary of the Army, Washington, D.C.

[21] Appl. No.: 868,863

[22] Filed: May 30, 1986

[51] Int. Cl.[4] ..... H01F 7/00

[52] U.S. Cl. ..... 335/301; 335/304

[58] Field of Search ..... 335/211, 214, 301, 302, 335/304, 306

[56] References Cited

U.S. PATENT DOCUMENTS

| | | | |
|---|---|---|---|
| 3,205,415 | 9/1965 | Seki et al. | 335/301 X |
| 3,227,931 | 1/1966 | Adler | 335/304 |
| 3,237,059 | 2/1966 | Meyerer | 335/306 X |
| 3,334,264 | 8/1967 | Niclas | 335/306 X |
| 3,768,054 | 10/1973 | Neugebauer | 335/306 X |
| 4,646,045 | 2/1987 | Chari et al. | 335/301 |
| 4,646,046 | 2/1987 | Vavrek et al. | 335/301 |

*Primary Examiner*—George Harris

*Attorney, Agent, or Firm*—Sheldon Kanars; Jeremiah G. Murray; John K. Mullarney

[57] ABSTRACT

A magnetic circuit with a frustum-shaped magnet having a longitudinal bore and circumscribed by a cladding magnet of varying radial thickness with a non-linear outer exterior surface. The cladding magnet is radially magnetized and the frustum-shaped magnet is axially magnetized, resulting in a constant magnetic potential along the non-linear outer exterior surface of the cladding magnet. A laterally uniform longitudinally increasing magnetic field is created within the bore.

9 Claims, 3 Drawing Figures

LEAKAGE-FREE, LINEARLY VARYING AXIAL PERMANENT MAGNET FIELD SOURCE

This invention may be manufactured and used by or for the Government for Governmental purposes without the payment of any royalties thereon or therefor.

CROSS REFERENCE TO RELATED APPLICATION

This application is related to the following copending application Ser. No. 868,862 filed on May 30, 1986 entitled "Parametric Linear Variation of A Leakage Free Permanent Magnet Field Source", in which the present applicant is a co-inventor.

BACKGROUND OF THE INVENTION

1. Field of The Invention

This invention relates generally to the field of magnetically cladded magnetic circuits for eliminating undesirable exterior magnetic fields and intensifying desired magnetic fields, and more specifically to a magnetic circuit having an increasing axial magnetic field and cladding therefor.

2. Description of Prior Art

Various magnetic devices requiring a controlled magnetic field, such as klystrons, traveling waves tubes, microwave devices, and other magnetic circuits have employed magnetic cladding to help intensify the desired controlled magnetic field as well as to reduce the exterior effects of the magnetic circuit on the surrounding environment due to magnetic field leakage. All of these devices have included a uniform controlled magnetic field.

Those concerned with the development of magnetic devices have long recognized the need for improving the magnetic intensity per unit weight of magnetic circuits, thereby improving the overall size and cost of such devices. The various prior art devices have used magnetic cladding to reduce the exterior flux leakage and increase the desired controlled magnetic field intensity without appreciably increasing the size or weight of the magnetic circuit. As a result, the prior art devices are configured so that most of the flux generated by a magnet creating the controlled magnetic field in directions skewed from the main axis of the controlled magnetic field is redirected to increase the magnetic intensity along the main axis. Although prior art devices have served their purpose, they have not been applicable in all situations and have not gone far enough in maximizing size and weight reduction.

SUMMARY OF THE INVENTION

In general, the invention comprehends a magnetic structure which comprises, means for generating a longitudinally varying laterally uniform magnetic field, and means for shielding the generating means preventing magnetic flux leakage therefrom.

In the present invention, the combination of the specific geometric configuration of the magnetic cladding structure and the specific orientations of the polarity of the cladding structure with respect to the magnetic circuit effect a considerable reduction in size, weight, and cost over that achievable with prior art structures. The magnetic cladding in the present invention is improved by taking advantage of the magnetic material's ability to be polarized in opposite directions, and by providing specific geometric configurations that result in constant magnetic potential on the exterior surface equal to the magnetic potential at a specific point on the magnetic circuit. The present invention also improves upon the ability of a magnetic circuit to create a longitudinally varying magnetic field.

It is therefore an object of this invention to provide an improved magnetic construction wherein a longitudinally varying magnetic field is created and wherein the leakage flux is minimized.

It is another object of the invention to provide a magnetic construction having an improved magnetic intensity per unit weight ratio.

It is a feature of this invention to have a hollow frustum shaped magnet generate a longitudinally varying magnet field cladded by a second magnet having a non-linear exterior outer surface which results in improved magnetic fields with reduced magnetic flux leakage.

It is an advantage of this invention that a longitudinally varying magnetic field can be generated with a substantial savings in size, weight, and cost.

The exact nature of this invention as well as other objects, features, and advantages thereof will be readily apparent from a consideration of the following specification.

DETAILED DESCRIPTION OF THE DRAWINGS

Figure 1:
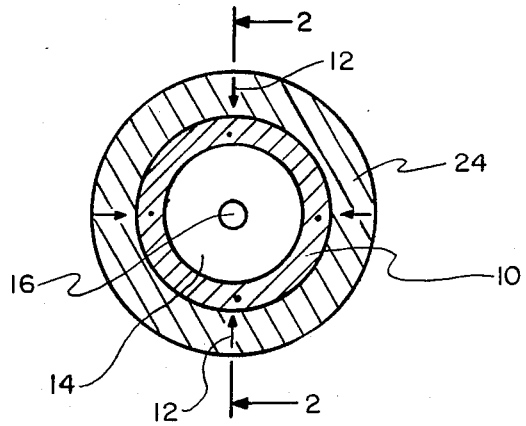
FIG. 1 is a cross section of the invention cut along the line 1—1 in FIG. 2 and looking in the direction of the arrows.

FIG. 1 shows a cross section of the present invention. Magnet 10 is a frustum shaped permanent magnet having a cylindrical concentric axial bore therethrough. Magnet 10 has a magnetic orientation or magnetization in the axial or longitudinal direction. Cladding magnet 24 surrounds magnet 10 and is magnetized in the radial direction. Arrows 12 indicate the direction of magnetization with the head of the arrow pointing in the direction of the magnet's north pole. The direction of magnetization of magnet 10 is represented by the dots on the cross section portion of magnet 10 indicating that the arrow is pointing perpendicularly out of the page with its head toward the viewer At the ends of magnet 10 irises 14 are attached having holes 16 therein. Both magnets 10 and 24 are permanent magnets and preferably composed of rare earth compounds.

Figure 2:
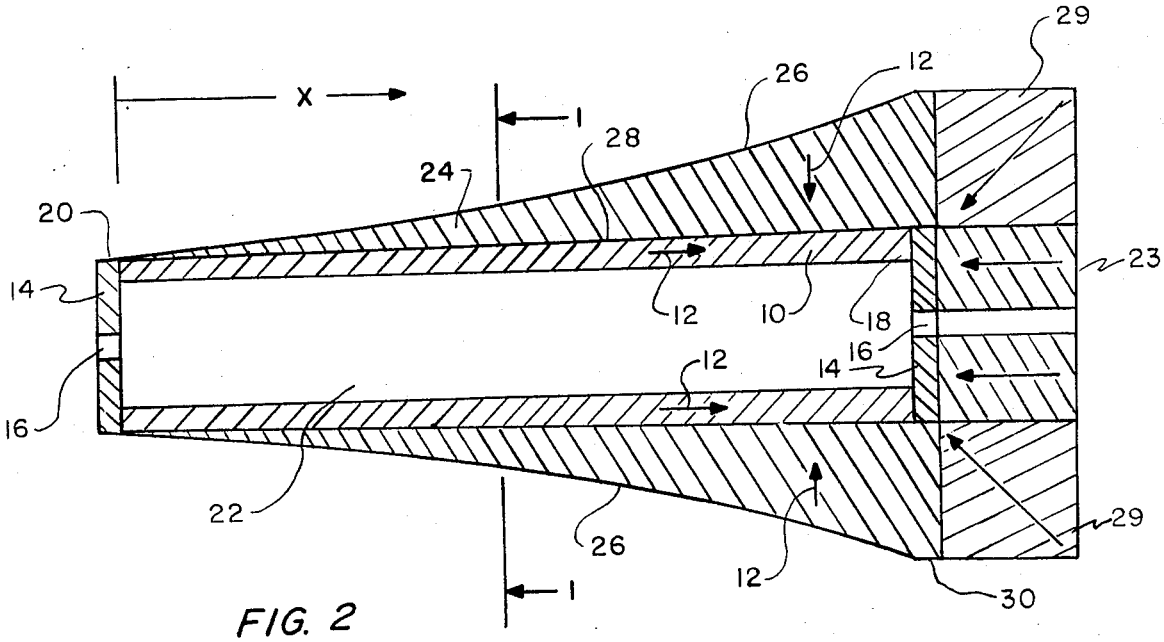
FIG. 2 is a longitudinal cross section of the invention cut along the line 2—2 in FIG. 1 and looking in the direction of the arrows.

FIG. 2 is a longitudinal cross section showing magnet 10 circumscribed by coaxially mounted magnet 24. Magnet 10 is tapered from tapered end 20 to end 18. Tapered end 20 is of smaller radial width than end 18. Magnet 24 has a variable radial width with a non-linear outer exterior surface 26. The outer exterior surface 26 of magnet 24 increases in radial thickness along the X direction as indicate in FIG. 2. The end of magnet 24 has a flat end surface 30 of constant radial thickness. This constant radial thickness represented by flat end surface 30 extends the axial width of iris 14. A first iris 14 is located adjacent the end 18 of magnet 10, and has a hole 16 therein. Adjacent the first iris 14 is positioned an axially magnetized bucking end magnet 23. Bucking end magnet 23 is cylindrically-shaped with an axial hole therethrough, and is magnetized axially in the direction shown by the arrows thereon. A ring-shaped bucking corner magnet 29 is positioned adjacent bucking end magnet 23 and cladding magnet 24. Corner magnet 29 is magnetized in the direction indicated by the arrows thereon. A second iris 14 is similarly placed adjacent tapered end 20 and also has a hole 16 therein. Magnet 10 has a coaxial cylindrical bore 22 extending therethrough. Arrows 12 represent the direction of magnetization of magnets 10 and 24. Arrows 12 represent the magnetic polarization of the magnet upon which they are located and point in the direction of the respective magnet's north pole.

Figure 3:
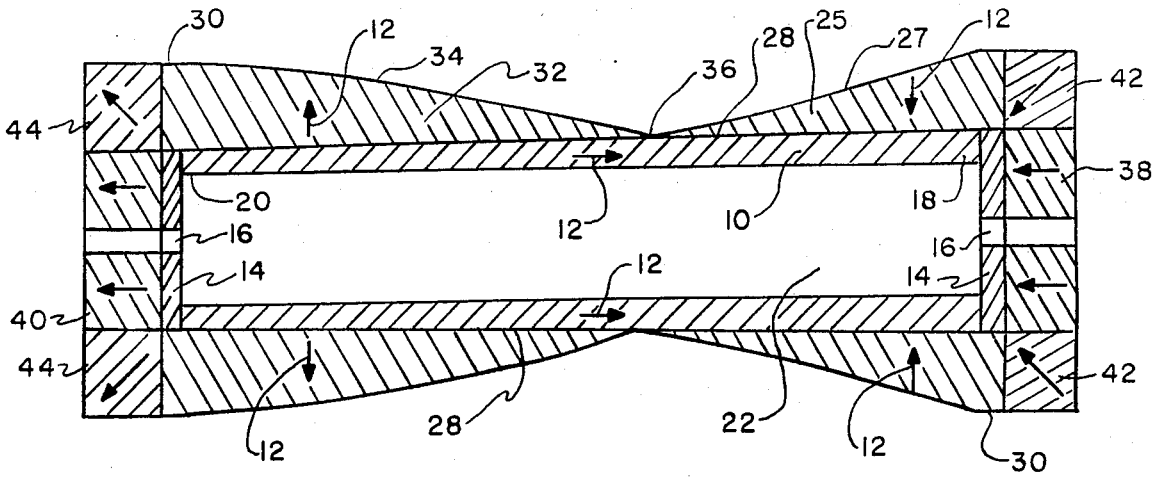
FIG. 3 is a longitudinal cross section of another embodiment of the invention.

FIG. 3 shows the longitudinal cross section of another embodiment of the present invention showing magnet 10 circumscribed by coaxially mounted magnets 25 and 32. Magnet 32 surrounds a portion of magnet 10 from tapered end 20 to the circumferential portion 36. Magnet 32 has a flat end surface 30. Flat end surface 30 extends the axial width of iris 14 adjacent tapered end 20. The radial width of magnet 32 over iris 14 is therefore constant. Magnet 32 has a non-linear outer exterior surface 34, with the exception of flat surface 30 as just described. The magnetization of magnet 32 is represented by arrows 12 thereon and is directed radially outward. Magnet 10 is circumscribed by coaxial magnet 25 from the circumferential portion 36 to the end 18. Magnet 25 has a flat end surface 30 extending the axial width of iris 14 adjacent end 18. Therefore, the radial thickness of magnet 25 over iris 14 adjacent end 18 is constant. The outer exterior surface 27 of magnet 25 is non-linear with the exception of flat end surface 30 as just described. The magnetization of magnet 25 is indicated by arrows 12 thereon and is directed radially inward. Adjacent iris 14 adjacent end 10 is positioned an axially magnetized bucking end magnet 38. Bucking end magnet 38 is cylindrically-shaped with a hole extending therethrough, and is magnetized axially in the direction shown by the arrows thereon. A ring-shaped bucking corner magnet 42 is positioned adjacent bucking end magnet 38 and cladding magnet 25. Corner magnet 42 is magnetized in the direction indicated by the arrows thereon. Similarly, adjacent iris 14 adjacent end 20 is positioned an axially magnetized augmenting end magnet 40. Augmenting end magnet 40 is cylindrically-shaped with a hole extending therethrough, and is magnetized axially in the direction shown by the arrows thereon. A ring-shaped augmenting corner magnet 44 is positioned adjacent augmenting end magnet 40 and cladding magnet 32. Corner magnet 44 is magnetized in the direction indicated by the arrows thereon.

The heads of the arrows on each magnet point in the direction of the respective magnet's north pole.

The operation of the device can best be understood with reference to FIG. 2. In FIG. 2 a beam of charged particles can enter bore 22 from tapered end 20 through hole 16 in iris 14. Bore 22 will contain a substantially laterally uniform linearly increasing axial magnetic field. The field increases from tapered end 20 to end 18. The increasing axial magnetic field in bore 22 is created by magnet 10 and made more intense by the interaction of magnet 24. The charged particle upon entering tapered end 20 will encounter the magnetic field within bore 22. The strength of the magnetic field will increase until a maximum at end 18. The charged particles will therefore travel down bore 22 in a spiral path of diminishing diameter. The magnetic potential difference between tapered end 20 and a point along the outer exterior surface 28 of magnet 10 increases to a maximum at end 18. Magnet 24 when magnetized in the direction indicated by arrows 12 will buck the magnetic potential difference between tapered end 20 and surface 28. The radial thickness of cladding magnet 24 is chosen so that the potential difference between a reference point and any point along surface 26 is equal to the potential difference between a reference point and tapered end 20. Therefore the magnetic potential at end 20 is the same as the magnetic potential along any point on surface 26. The absence of any potential difference between points along surface 26 results in substantially reduced magnetic flux leakage. This reduced magnetic flux leakage helps to eliminate the exterior effects of the magnetic circuit on the surrounding environment as well as contributes to the intensification of the magnetic field within bore 22.

Irises 14 adjacent each end of magnet 10 are made of a soft magnetic material such as iron and aid in making the magnetic field within bore 22 more uniform in the lateral or radial direction. Bucking end magnet 23 is placed adjacent end 14 adjacent end 18 to buck or reduce the magnetic potential along the outer exterior surface of end 14 to lower the magnetic potential to a value equal to that at tapered end 20. Ring-shaped bucking corner magnet 29 bucks the magnetic potential along the adjacent surfaces of magnets 24 and 23. Ideally corner magnet 29 should have a varying direction of magnetization ranging from the magnetic direction of cladding magnet 24 to the magnetic direction of end magnet 23. Magnets 10, 23, 24 and 29 are permanent magnets preferably composed of rare earth elements and having a high coercive force, and ideally a Sm-Co type magnetic material that has a linear demagnetization curve with a slop of approximately one.

The operation of the embodiment of the invention shown in FIG. 3 is similar to the operation of the embodiment of the invention shown in FIG. 2. The embodiment as shown in FIG. 3 has a configuration which requires substantially less magnetic material than the embodiment of FIG. 2. Referring to FIG. 3 the magnetic potential difference from tapered end 20 along surface 28 to end 18 increases to a maximum at end 18. The magnetic potential difference between tapered end 20 and surface 34 is equal to the magnetic potential difference between tapered end 20 and circumferential portion 36. Magnet 32 is magnetized as shown by arrows 12 and acts to increase or augment the magnetic potential along surface 28 to equal the magnetic potential at circumferential portion 36 with respect to a common reference magnetic potential. The surface 34 is non-linear because the magnetic potential difference between tapered end 20 and end 18 along surface 28 while progressing toward end 18 increases non-linearly. The magnetic potential difference along surface 28 extending beyond circumferential portion 36 toward end 18 continues to increase with respect to tapered end 20. Therefore, magnet 25 is magnetized as shown by arrows 12 to buck or reduce the magnetic potential along surface 28. Magnet 25 reduces the magnetic potential along surface 28 to form a constant magnetic potential along surface 27 equal to the magnetic potential at circumferential portion 36 with respect to a common reference magnetic potential. The magnetic potential of irises 14 being constant over their surface result in the flat end surfaces 30. Therefore, surfaces 34 and 27 are at the same magnetic potential as circumferential portion 36 with reference to a common reference magnetic potential. Even though the magnetic potential of surfaces 34 and 27 is greater than the magnetic potential at tapered end 20 little magnetic flux leakage will result due to the lack of any potential difference along the surfaces 34 and 27. Therefore, the reduced magnetic flux leakage intensifies the magnetic field within bore 22. To avoid magnetic flux leakage from iris 14 adjacent end 18, bucking end magnet 38 and bucking corner magnet 42 are placed at end 18 as in the embodiment of FIG. 2. Magnet 38 and 42 buck or reduce the magnetic potential at end 18 to a value equal to that of circumferential portion 36. At end 20 augmenting corner magnet 44 and augmenting end magnet 40 are positioned to raise or increase the magnetic potential at end 20 to a value equal to the magnetic potential at circumferential portion 36. This helps reduce magnetic flux leakage at end 20. In this embodiment, because the magnets 25 and 32 do not have to contend with the entire magnetic potential difference of magnet 10 substantial savings in magnetic material can be achieved while accomplishing the same results of intensifying the magnetic field and reducing the magnetic flux leakage as found in the embodiment of FIG. 2. The greatest savings can be achieved when the circumferential portion 36 is chosen to be the axial magnetic mid point of magnet 10.

It should be understood that the embodiments depicted can be combined in different configurations, and that numerous modifications or alterations may be made therein without departing from the spirit and scope of the invention as set forth in the appended claims.

What is claimed is:

1. A magnetic circuit having low magnetic leakage comprising:

means for generating a longitudinally linearly increasing magnetic field; and means for shielding said generating means preventing magnetic flux leakage therefrom;

said generating means comprising a frustum shaped first permanent magnet having a concentric cylindrical axial bore extending therethrough and a magnetization in the axial direction;

said shielding means comprising a cladding permanent magnet surrounding said first magnet and having a generally radial magnetization transverse to the axial magnetization of said first magnet, and having a non-linear outer exterior surface with the greatest radial width of said cladding magnet adjacent the greatest radial width of said first magnet.

2. A magnetic circuit as in claim 1 further comprising:

an iris of a soft magnetic material placed adjacent each end of said first magnet.

3. A magnetic circuit as in claim 2 further comprising:

an axially magnetized cylindrical end magnet having an axial hole therethrough adjacent the iris next to the end adjacent the greatest radial width of said cladding magnet; and a ring-shaped corner magnet adjacent said end magnet and said cladding magnet.

4. A magnetic circuit having low magnetic leakage comprising:

a frustum shaped first permanent magnet having a concentric cylindrical axial bore extending therethrough and a magnetization in the axial direction;

a first cladding permanent magnet surrounding a first portion of said first magnet, and having a generally radial magnetization transverse to the axial magnetization of said first magnet, and having a non-linear outer exterior surface with the greatest radial width of said first cladding magnet adjacent one end of said first magnet, and the narrowest radial width of said first cladding magnet extending to a circumferential portion between the ends of said first magnet; and a second cladding permanent magnet surrounding a second portion of said first magnet, and having a generally radial magnetization transverse to the axial magnetization of said first magnet, and having a non-linear outer exterior surface with the smallest radial width of said second cladding magnet adjacent said first cladding magnet and the greatest radial width of said second cladding magnet adjacent the other end of said first magnet.

5. A magnetic circuit as in claim 4 wherein:

said circumferential portion is located substantially at the magnetic midpoint of said first magnet.

6. A magnetic circuit as in claim 4 wherein said first cladding magnet is radially magnetized with a polarity opposite to the radial magnetization of said second cladding magnet.

7. A magnetic circuit as in claim 6 wherein:

said first cladding magnet augments the magnetic potential along the outer exterior surface of said first portion of said first magnet; and said second cladding magnet bucks the magnetic potential along the outer exterior surface of said second portion of said first magnet.

8. A magnetic circuit as in claim 7 further comprising:

iris of a soft magnetic material placed adjacent each end of said first magnet.

9. A magnetic circuit as in claim 8 further comprising:

a cylindrical axially magnetized bucking end magnet having a hole therethrough adjacent the end adjacent the greatest radial width of said second cladding magnet, a ring-shaped bucking corner magnet adjacent said bucking end magnet and said second cladding magnet, a cylindrical axially magnetized augmenting end magnet having a hole therethough adjacent the narrowest radial width of said first cladding magnet; and a ring-shaped augmenting corner magnet adjacent said augmenting corner end magnet and said first cladding magnet.

* * * * *